US010019927B2

(12) United States Patent
Lee et al.

(10) Patent No.: US 10,019,927 B2
(45) Date of Patent: Jul. 10, 2018

(54) DISPLAY DEVICE AND DRIVING METHOD THEREOF SUPPRESSING POWER VOLTAGE RIPPLES

(71) Applicant: SAMSUNG DISPLAY CO., LTD., Yongin-si, Gyeonggi-Do (KR)

(72) Inventors: Jeong Doo Lee, Yongin-si (KR); Min Young Park, Yongin-si (KR); Ki Hyun Pyun, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 35 days.

(21) Appl. No.: 15/000,680

(22) Filed: Jan. 19, 2016

(65) Prior Publication Data

US 2016/0365019 A1 Dec. 15, 2016

(30) Foreign Application Priority Data

Jun. 11, 2015 (KR) ..... 10-2015-0082766

(51) Int. Cl.
*G09G 3/20* (2006.01)

(52) U.S. Cl.
CPC ... *G09G 3/2003* (2013.01); *G09G 2320/0673* (2013.01)

(58) Field of Classification Search
None
See application file for complete search history.

(56) References Cited

U.S. PATENT DOCUMENTS

2007/0229435 A1* 10/2007 Lee ..... G09G 3/2011 345/98
2008/0122814 A1* 5/2008 Shin ..... G09G 3/3648 345/204
2010/0007639 A1* 1/2010 Jeong ..... G09G 3/2007 345/208
2010/0164967 A1* 7/2010 Lee ..... G09G 5/003 345/522
2010/0254108 A1* 10/2010 Kim ..... G09G 3/3696 361/782

(Continued)

FOREIGN PATENT DOCUMENTS

KR 10-2005-0082964 8/2005
KR 10-2006-0014253 2/2006
KR 10-2011-0070356 6/2011

*Primary Examiner* — Grant Sitta
*Assistant Examiner* — Amen Bogale
(74) *Attorney, Agent, or Firm* — F. Chau & Associates, LLC.

(57) ABSTRACT

A display device and a driving method thereof can reduce or prevent deterioration of image quality caused by ripples of a power voltage. A display device includes a gamma reference voltage generator generating a plurality of gamma reference voltages using a power voltage. A gamma selection signal generator generates a gamma selection signal corresponding to at least one gamma reference voltage among the gamma reference voltages and the power voltage. A gamma data supply unit stores a plurality of gamma data sets and outputs a gamma data set corresponding to the gamma selection signal from among the gamma data sets. A data driver generates a data signal using the gamma data set supplied from the gamma data supply unit and the gamma reference voltages. A display unit includes data lines transmitting the data signal.

10 Claims, 5 Drawing Sheets

(56) References Cited

U.S. PATENT DOCUMENTS

| | | | | |
|---|---|---|---|---|
| 2011/0012882 | A1* | 1/2011 | Jeong | G09G 3/3688 345/211 |
| 2012/0249507 | A1 | 10/2012 | Chung et al. | |
| 2013/0147864 | A1* | 6/2013 | Kim | G09G 3/3607 345/691 |

* cited by examiner

| ⊿V RANGE | FGS |
|---|---|
| 0V~0.2V | 000 |
| 0.2V~0.4V | 001 |
| 0.4V~0.6V | 010 |
| 0.6V~0.8V | 011 |
| 0.8V~1.0V | 100 |
| 1.0V~1.2V | 101 |
| 1.2V~1.4V | 110 |
| 1.4V~1.6V | 111 |

DISPLAY DEVICE AND DRIVING METHOD THEREOF SUPPRESSING POWER VOLTAGE RIPPLES

CROSS REFERENCE TO RELATED APPLICATIONS

This application claims priority to and the benefit of Korean Patent Application No. 10-2015-0082766, filed on Jun. 11, 2015, in the Korean Intellectual Property Office, the entire contents of which are incorporated by reference herein in their entirety.

TECHNICAL FIELD

An aspect of the present invention relates to a display device and a driving method thereof, and more particularly, to a display device and a driving method thereof, which can prevent deterioration of image quality, caused by ripples of a power voltage.

DISCUSSION OF THE RELATED ART

A display device may generate a power voltage from an input voltage. The power voltage is used as a source voltage for driving various types of circuit elements.

As an example, a liquid crystal display device may generate a high-potential power voltage by boosting an input voltage, and generate gate drive voltages, and/or a common voltage by using the generated high-potential power voltage. The high-potential power voltage may be used as a source voltage for driving an output buffer of a data driver.

SUMMARY

Exemplary embodiments of the present invention provide a display device and a driving method thereof, which can prevent deterioration of image quality, caused by ripples of a power voltage.

According to an aspect of the present invention, a display device includes a gamma reference voltage generator configured to generate a plurality of gamma reference voltages using a power voltage. A gamma selection signal generator is configured to generate a gamma selection signal corresponding to at least one gamma reference voltage among the gamma reference voltages and the power voltage. A gamma data supply unit is configured to store a plurality of gamma data sets and output a gamma data set corresponding to the gamma selection signal among the gamma data sets. A data driver is configured to generate a data signal using the gamma data set supplied from the gamma data supply unit and the gamma reference voltages. A display unit includes a plurality of data lines supplied with the data signal.

The gamma selection signal generator may include a representative value calculator configured to calculate a representative value of the power voltage in every frame period. A comparator may be configured to output a comparison value by detecting a difference between the representative value and the at least one gamma reference voltage. An analog-digital converter may be configured to generate the gamma selection signal corresponding to the comparison value.

The comparator may be synchronized with a start frame control signal supplied in every frame period to output the comparison value.

The gamma data supply unit may include a gamma data storage unit in which the plurality of gamma data sets are stored and a gamma selector configured to selectively output a gamma data set corresponding to the gamma selection signal among the gamma data sets.

The gamma data storage unit may include a plurality of look-up tables in which a plurality of gamma voltages included in the respective gamma data sets are stored.

Each of the gamma data sets may include a plurality of gamma voltages having values between the gamma reference voltages.

The display device may further include a timing controller configured to control the gamma selection signal generator and the data driver.

The gamma data supply unit may be part of the timing controller.

The data driver may include a plurality of sub-data drivers each of which may be configured to supply a data signal to one or more of the data lines.

The gamma selection signal generator may include a plurality of sub-gamma selection signal generators provided in the respective sub-data drivers.

The gamma data supply unit may output the gamma data set to each of the sub-data drivers, corresponding to the gamma selection signal input from each of the sub-gamma selection signal generators.

According to an aspect of the present invention, there is provided a method of driving a display device, the method includes outputting a comparison value by comparing a power voltage with at least one gamma reference voltage among a plurality of gamma reference voltages. A gamma selection signal corresponding to the comparison value is generated. A gamma data set corresponding to the gamma selection signal is selected from among a plurality of previously stored gamma data sets and the selected gamma data set is outputted. A data signal corresponding to input data is generated using the selected gamma data set and the gamma reference values. An image corresponding to the data signal is displayed.

The outputting of the comparison value may include calculating a representative value of the power voltage in every frame period and generating the comparison value by detecting a difference between the representative value and the at least one gamma reference voltage.

The generating of the gamma selection signal may include generating a digital code corresponding to a voltage range of the comparison value.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION

Figure 1:
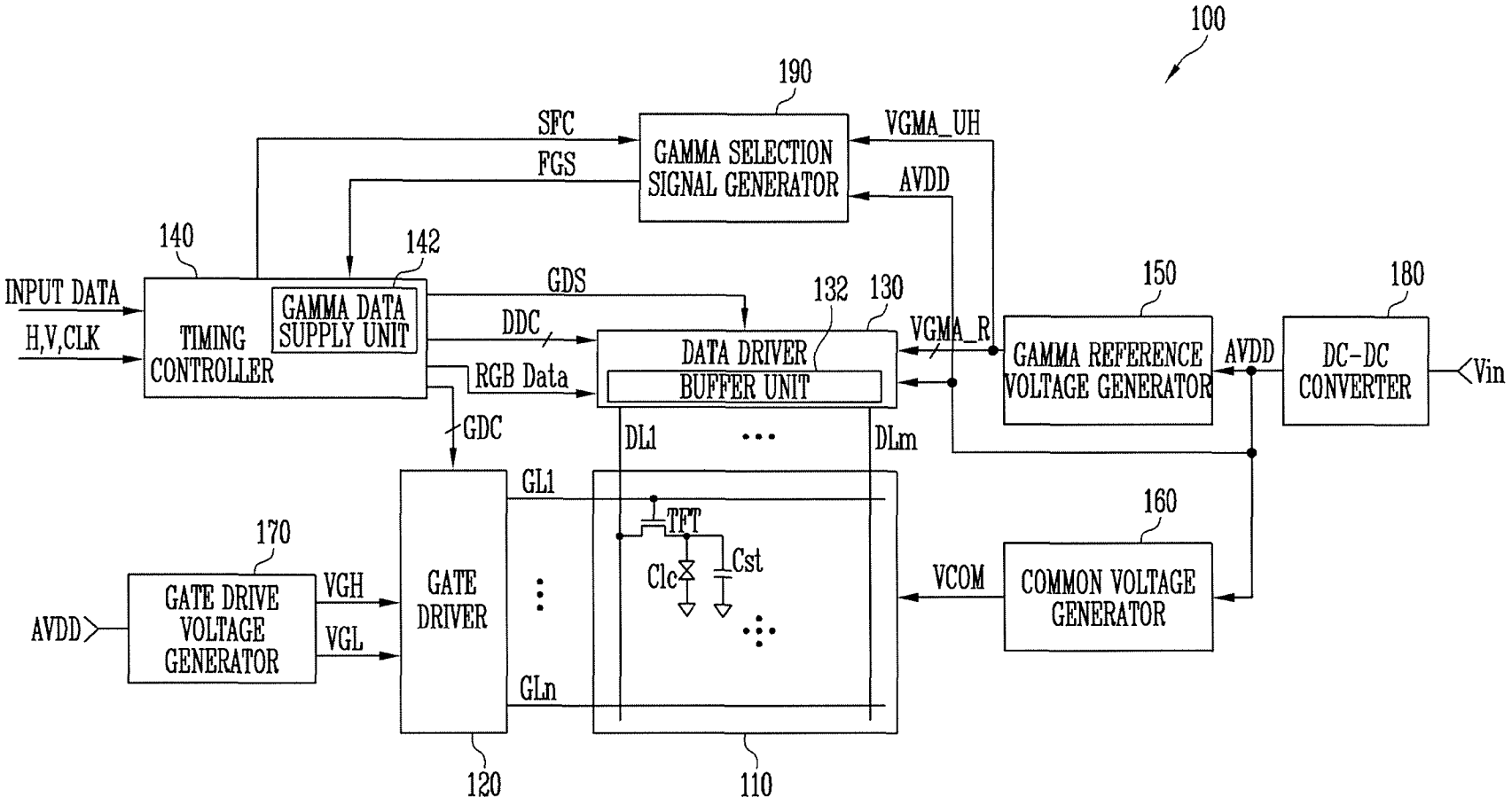
FIG. 1 is a schematic diagram of a display device according to an exemplary embodiment of the present invention.

Example embodiments of the present invention will now be described more fully hereinafter with reference to the accompanying drawings. However, the present invention may be embodied in different forms and should not be construed as limited to the embodiments set forth herein. Rather, these embodiments are provided so that this disclosure will be thorough and complete, and will fully convey the scope of the exemplary embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals may refer to like elements throughout.

Figure 2:
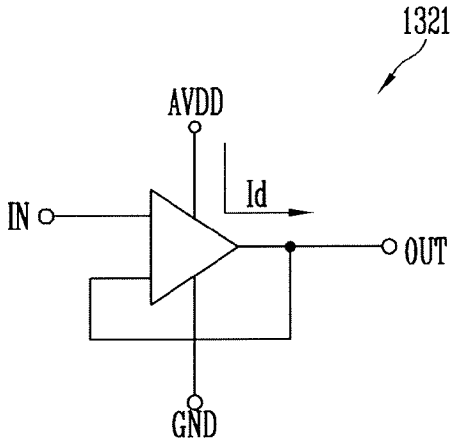
FIG. 2 is a circuit diagram illustrating an example of an output buffer provided in a buffer unit shown in FIG. 1.

FIG. 1 is a schematic diagram of a display device according to an embodiment of the present invention. FIG. 2 is a circuit diagram illustrating an example of an output buffer provided in a buffer unit shown in FIG. 1.

For convenience, in FIG. 1, a liquid crystal display device will be described as an example of the display device to which the present invention is applicable. However, the present invention is not limited thereto, and may be applied to other types of display devices such as organic light emitting display (OLED) devices.

Referring to FIG. 1, the display device 100 according to the embodiment of the present invention includes a liquid crystal display panel 110, a gate driver 120 and a data driver 130 for driving the display panel 110, a timing controller 140 for controlling at least the gate driver 120 and the data driver 130, a gamma reference voltage generator 150 for generating a gamma reference voltage VGMA_R, a common voltage generator 160 for generating a common voltage VCOM, and a gate drive voltage generator 170 for generating gate drive voltages VGH and VGL. These voltages may be generated by using a DC-DC converter 180 for generating a power voltage AVDD by using an input voltage Vin.

The display device 100 according to an exemplary embodiment of the present invention further includes a gamma selection signal generator 190 for generating a gamma selection signal (frame gamma selection; FGS) corresponding to a power voltage AVDD and at least one gamma reference voltage, e.g., positive high gamma reference voltage VGMA_UH.

The display panel 110 may be a liquid crystal display (LCD) panel including two glass or plastic substrates and a liquid crystal layer injected therebetween. A plurality of gate lines GL1 to GLn formed in the display panel 110 are supplied with gate signals and a plurality of data lines DL1 to DLm, also supplied in the display panel 110 are supplied with data signals.

The display panel 110 includes a plurality of pixels coupled to the gate lines GL1 to GLn and the data lines DL1 to DLm. Each of the plurality of pixels includes a thin film transistor TFT coupled to a gate line GL and a data line disposed on corresponding horizontal/vertical lines, and a liquid crystal cell Clc and a storage capacitor Cst, which are coupled to the thin film transistor TFT.

A gate electrode of the thin film transistor TFT is coupled to the gate line GL, and a first electrode of the thin film transistor TFT is coupled to the data line DL. A second electrode of the thin film transistor TFT is coupled to a pixel electrode of the liquid crystal cell Clc and one electrode of the storage capacitor Cst. The thin film transistor TFT is turned on in response to a gate signal, e.g., a scan signal, supplied to the gate line GL.

If the thin film transistor TFT is turned on, a data signal supplied to the data line DL is supplied to the pixel electrode of the liquid crystal cell Clc. In this case, a common voltage VCOM is supplied to a common electrode of the liquid crystal cell Clc. Thus, the arrangement of liquid crystal molecules of the liquid crystal cell Clc is changed by an electric field generated between the pixel electrode and the common electrode, so that the emission of incident light supplied from a backlight (not shown) is controlled. Accordingly, light with a grayscale corresponding to the data signal is transmitted through the pixel.

The data signal supplied via the thin film transistor TFT is stored in the storage capacitor Cst. The storage capacitor Cst may be coupled between the second electrode of the thin film transistor TFT and the common electrode, or may be coupled between the second electrode of the thin film transistor TFT and a gate line of a previous stage, or the like. The voltage of the liquid crystal cell Clc is maintained by the storage capacitor Cst until a data signal of a next frame is supplied.

The gate driver 120 sequentially generates a gate signal corresponding to a gate drive control signal GDC supplied from the timing controller 140. The gate signal generated by the gate driver 120 is sequentially supplied to the gate lines GL1 to GLn. High-level and low-level voltages of the gate signal may be determined by a gate high voltage VGH and a gate low voltage VGL, supplied from the gate drive voltage generator 170.

The data driver 130 generates a data signal, corresponding to a drive control signal DDC and image data RGB Data, supplied from the timing controller 140. For example, the data driver 130 may generate a data signal by sampling and latching digital image data RGB Data and then converting the digital image data RGB Data into an analog data voltage capable of expressing a grayscale in the liquid crystal cell Clc.

In this case, the data driver 130 may convert digital image data RGB Data into an analog data voltage, using a gamma data set GDS supplied from a gamma data supply unit 142 and gamma reference voltages VGMA_R supplied from the gamma reference voltage generator 150.

For example, the data driver 130 may generate data signals with 256 different available grayscales, based on the gamma data set GDS and 18 different gamma voltages VGMA1 to VGMA 18 included in the gamma reference voltages VGMA_R.

The data signal converted in the analog data voltage may be supplied to the data lines DL1 to DLm via a buffer unit 132 provided at an output stage of the data driver 130.

The buffer unit 132 may include a plurality of output buffers coupled to the respective data lines DL. For example, as shown in FIG. 2, each of the plurality of output buffers may be designed as a buffer amplifier using the power voltage AVDD as a source voltage.

Referring to FIG. 2, a data signal converted into an analog data voltage is input to an input terminal IN of an output buffer 1321, and an output terminal OUT of the output buffer 1321 is coupled to a data line DL of a corresponding vertical line.

However, since the output buffer 1321 of the data driver 130 uses, as a source voltage, the power voltage AVDD in which ripples may be generated, the output value of the output buffer 1321 may be changed due to ripples, which may be caused, for example, by load changes for the DC-DC converter 180.

For example, if ripples are generated in the power voltage AVDD due to load changes of the panel, etc., the voltage value of the power voltage AVDD is changed. Therefore, the output current Id of the output buffer 1321 is changed due to a variation of the power voltage AVDD.

For example, although the same input voltage is supplied to the input terminal IN of the output buffer 1321, the output current Id decreases if the voltage value of the power voltage AVDD increases. Similarly, if the voltage value of the power voltage AVDD decreases, the output current Id decreases. Accordingly, the voltage of the output terminal OUT is changed, and therefore, the gamma value of an image to be displayed may be distorted. For example, although a data signal is generated by setting gamma 2.2 as a target, there may occur a phenomenon in which the gamma value of an image is decreased or increased as a variation of the power voltage AVDD is generated.

Accordingly, exemplary embodiments of the present invention provide various systems and methods for reducing or preventing deterioration of image quality caused by ripples of the power voltage AVDD. Particularly, gamma voltages may be differentially applied according to voltage values of the power voltage AVDD, thereby uniformly maintaining the gamma value of an image and increasing image quality. This is described in detail below.

Referring back to FIG. 1, the timing controller 140 aligns input data provided from an external source, and supplies image data RGB Data to the data driver 130. The timing controller 140 generates a gate drive control signal GDC and a data drive control signal DDC by using horizontal/vertical synchronization signals H and V and a clock signal CLK, and supplies the horizontal/vertical synchronization signals H and V and the clock signal CLK to the respective gate and data drivers 120 and 130.

The timing controller 140 may control an operation of the gamma selection signal generator 190 by supplying a control signal such as a start frame control signal SFC to the gamma selection signal generator 190.

The timing controller 140 supplies a gamma data set GDS including a plurality of gamma voltages to the data driver 130.

According to an exemplary embodiment of the present invention, the timing controller 140 may store a plurality of gamma data sets, instead of a single gamma data set, and may select a gamma data set GDS corresponding to a gamma selection signal FGS corresponding to the voltage value of a power voltage AVDD to be supplied to the data driver 130. The timing controller 140 may include the gamma data supply unit 142.

The gamma data supply unit 142 stores a plurality of gamma data sets GDS, and supplies to the data driver 130, a gamma data set GDS corresponding to a gamma selection signal FGS supplied from the gamma selection signal generator 190 among the gamma data sets GDS.

For example, the gamma data supply unit 142 may receive a gamma selection signal FGS supplied from the gamma selection signal generator 190 at every frame, and the gamma data supply unit 142 may select a gamma data set GDS corresponding to the supplied gamma selection signal FGS to be output to the data driver 130.

Each of the gamma data sets GDS may include the other gamma voltages except gamma reference voltages VGMA_R supplied from the gamma reference voltage generator 150 to the data driver 130 among gamma voltages used to generate a data signal. For example, each of the gamma data sets GDS may include a plurality of gamma voltages having values between the gamma reference voltages VGMA_R.

For example, when assuming that the data driver 130 generates a data signal as an analog data voltage by using 18 gamma voltages, e.g., VGMA1 to VGMA18, VGMA1, VGMA9, VGMA10, and VGMA18 as positive and negative high/low gamma reference voltages VGMA_UH, VGMA_UL, VGMA_LH, and VGMA_LL may be supplied from the gamma reference voltage generator 150 to the data driver 130. The other 14 gamma voltages, e.g., VGMA2 to VGMA 8 and VGMA 11 to VGMA 17 may be supplied from the gamma data supply unit 142 to the data driver 130. The VGMA2 to VGMA 8 and VGMA 11 to VGMA 17 may be included in each of the gamma data sets GDS.

However, the voltage value of at least one gamma voltage stored in the gamma data sets GDS may be set differently. For example, the voltage value is set based on ripples of the power voltage AVDD, and consequently, may be adjusted so as to maintain a uniform image.

For example, according to an exemplary embodiment of the present invention, the gamma voltage is changed by reflecting ripples of the power voltage AVDD, so that the image quality may be increased by uniformly maintaining the gamma value of an image.

It is illustrated that the gamma data supply unit 142 is provided in the timing controller 140, but the present invention is not necessarily limited thereto. For example, the gamma data supply unit 142 may be configured as a separate circuit unit.

The configuration and operation of the gamma data supply unit 142 is described in detail below.

The gamma reference voltage generator 150 generates a plurality of gamma reference voltages VGMA_R by using a power voltage AVDD supplied by the DC-DC converter 180.

According to an exemplary embodiment of the present invention, the plurality of gamma reference voltages VGMA_R may be VGMA_UH, VGMA_UL, VGMA_LH, and VGMA_LL, which are positive and negative high/low gamma reference voltages.

The gamma reference voltages VGMA_R generated by the gamma reference voltage generator 150 are supplied to the data driver 130.

According to an exemplary embodiment of the present invention, at least one of the plurality of gamma reference voltages VGMA_R is supplied to the gamma selection signal generator 190. For example, the positive high gamma reference voltage VGMA_UH having the highest voltage level may be provided to the gamma selection signal generator 190. The positive high gamma reference voltage VGMA_UH provided to the gamma selection signal generator 190 may be used as a reference voltage for determining a voltage change degree of the power voltage AVDD.

The common voltage generator 160 is supplied with a power voltage AVDD, and generates a common voltage VCOM by using the supplied power voltage AVDD. The common voltage VCOM generated by the common voltage generator 160 is supplied to the common electrode of the liquid crystal cell Clc provided in each pixel.

The gate drive voltage generator 170 is supplied with a power voltage AVDD, and generates a gate high voltage VGH and a gate low voltage VGL by using the supplied power voltage AVDD. The gate high voltage VGH and the gate low voltage VGL, generated by the gate drive voltage generator 170, are supplied to the gate driver 120.

The gate high voltage VGH may be set as a voltage greater than or equal to the threshold voltage of the thin film transistor TFT provided in each pixel, and the gate low voltage VGL may be set as a voltage less than the threshold voltage of the thin film transistor TFT. The gate high voltage VGH and the gate low voltage VGL may be respectively used to determine high-level and low-level voltages of a gate signal generated by the gate driver 120.

The DC-DC converter 180 generates a power voltage AVDD by using an input voltage Vin supplied from an external source. For example, the DC-DC converter 180 may generate a high-potential power voltage AVDD by boosting the input voltage Vin. Accordingly, the DC-DC converter 180 may include a boosting circuit.

The power voltage AVDD generated by the DC-DC converter 180 may be supplied to the gamma reference voltage generator 150, the common voltage generator 160, the gate drive voltage generator 170, and/or the data driver 130. Additionally, according to an exemplary embodiment of the present invention, the power voltage AVDD is further supplied to the gamma selection signal generator 190.

The gamma selection signal generator 190 supplied with both the power voltage AVDD and at least one gamma reference voltage generated by the gamma reference voltage generator 150, e.g., a positive high gamma reference voltage VGMA_UH.

The gamma selection signal generator 190 generates a gamma selection signal FGS, corresponding to the power voltage AVDD and the at least one gamma reference voltage. The gamma selection signal FGS generated by the gamma selection signal generator 190 may be supplied to the timing controller 140, for example, the gamma data supply unit 142, to be used in selecting a gamma data set GDS.

The operation of the gamma selection signal generator 190 may be controlled by the timing controller 140. For example, the operation of the gamma selection signal generator 190 may be controlled by a start frame control signal SFC supplied from the timing controller 140.

The configuration and operation of the gamma selection signal generator 190 is described in detail below with reference to FIGS. 3 to 5.

Figure 3:
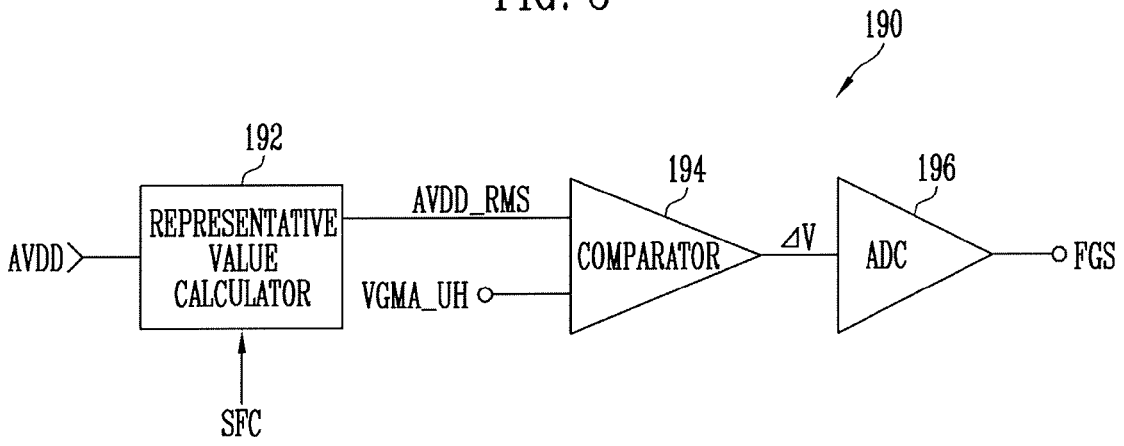
FIG. 3 is a schematic diagram illustrating an example of a gamma selection signal generator shown in FIG. 1.

FIG. 3 is a schematic diagram illustrating an example of the gamma selection signal generator shown in FIG. 1. FIG. 4 is a waveform diagram illustrating an operation of the gamma selection signal generator shown in FIG. 3. FIG. 5 is a table illustrating an example of a gamma selection signal output from the gamma selection signal generator shown in FIG. 3.

Referring to FIG. 3, the gamma selection signal generator 190 may include a representative value calculator 192, a comparator 194, and an analog-digital converter (hereinafter, referred to as an ADC) 196.

The representative value calculator 192 is provided with a power voltage AVDD and a control signal, and calculates and outputs a representative value of the power voltage AVDD, corresponding to the control signal.

For example, the representative value calculator 192 may calculate a representative value of the power voltage AVDD in every frame period, corresponding to the control signal, and output the calculated representative value to the comparator 194. A start frame control signal SFC, or the like, supplied from the timing controller 140 of FIG. 1 may be used as the control signal, and the representative value may be set as an effective value (e.g. root mean square; RMS).

For example, the representative value calculator 192 may be synchronized with the start frame control signal SFC supplied in every frame period, to calculate an effective value AVDD_RMS of the power voltage AVDD and supply the calculated effective value AVDD_RMS to the comparator 194. For example, at the beginning of each frame, the representative value calculator 192 may calculate an effective value AVDD_RMS of the power voltage AVDD supplied until just before the frame and supply the calculated effective value AVDD_RMS to the comparator 194, thereby driving the comparator 194. In this case, the start frame control signal SFC may serve as a reset signal.

The comparator 194 compares the representative value of the power voltage AVDD, e.g., the effective value AVDD_RMS supplied from the representative value calculator 192 with at least one gamma reference voltage, e.g., a positive high gamma reference voltage VGMA_UH supplied from the gamma reference voltage generator 150 of FIG. 1, thereby detecting a difference therebetween. For example, the comparator 194 detects a difference between the representative value of the power voltage AVDD and at least one gamma reference voltage, thereby outputting a comparison value ΔV.

The representative value calculator 192 may be synchronized with the start frame control signal SFC supplied in every frame period to supply the representative value of the power voltage AVDD, and therefore, the comparator 194 may be synchronized with the start frame control signal SFC to output the comparison value ΔV.

Figure 4:
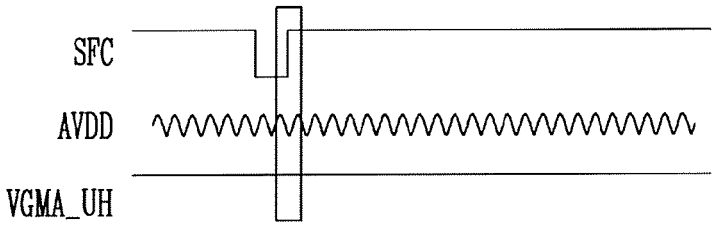
FIG. 4 is a waveform diagram illustrating an operation of the gamma selection signal generator shown in FIG. 3.

For example, if a low-level start frame control signal SFC is supplied, as shown in FIG. 4, the representative value calculator 192 may calculate a representative value of a power voltage AVDD supplied until just before a point of time when the voltage level of the start frame control signal SFC increases from a low level to a high level, and output the calculated representative value to the comparator 194. Then, the comparator 194 may generate a comparison value ΔV by comparing the representative value of the power voltage AVDD, input from the representative value calculator 192, with at least one gamma reference voltage, and output the generated comparison value ΔV.

The comparison value ΔV output from the comparator 194, e.g., the difference voltage between the effective value AVDD_RMS of the power voltage AVDD and the positive high gamma reference voltage VGMA_UH, is supplied to the ADC 196.

The ADC 196 generates a gamma selection signal FGS corresponding to the comparison value ΔV supplied from the comparator 194. The ADC 196 may generate a gamma selection signal FGS in the form of a digital code, corresponding to a voltage range of the comparison value ΔV having an analog voltage value.

For example, assuming that the voltage range of the comparison value is within a range of about 0V to about 1.6V, the ADC 196 may divide the voltage range of the comparison value ΔV based on a number of cases corresponding to a bit number of the gamma selection signal FGS, and generate a digital gamma selection signal FGS corresponding to the divided voltage range of the comparison value ΔV.

Figures 5, 6:
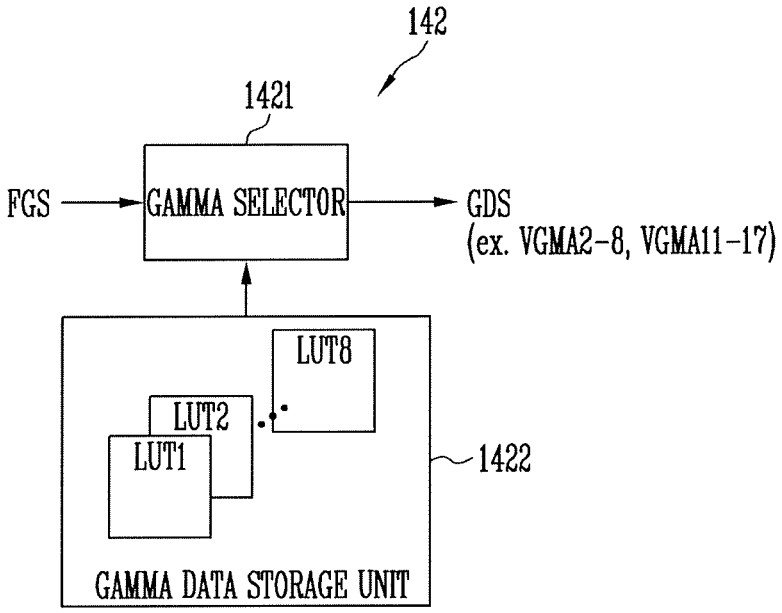
FIG. 5 is a table illustrating an embodiment of a gamma selection signal output from the gamma selection signal generator shown in FIG. 3.
FIG. 6 is a schematic diagram illustrating an example of a gamma data supply unit shown in FIG. 1.

For example, when assuming that the gamma selection signal FGS is set to a 3-bit digital value, the voltage range of the comparison value ΔV may be divided into eight voltage ranges by dividing 0.2V into 0V to 1.6V as the voltage range of the comparison value ΔV as shown in FIG. 5, and provide 3-bit digital codes, e.g., digital codes of "000" to "111," corresponding to the respective voltage ranges.

Accordingly, the ADC 196 converts the comparison value ΔV having an analog voltage value into a gamma selection signal FGS in the form of a digital code.

The gamma selection signal FGS generated in the ADC 196 may be supplied to the gamma data supply unit 142 of FIG. 1, to be used in selecting a gamma data set GDS.

FIG. 6 is a schematic diagram illustrating an example of the gamma data supply unit shown in FIG. 1.

Referring to FIG. 6, the gamma data supply unit 142 may include a gamma selector 1421 and a gamma data storage unit 1422.

The gamma selector 1421 selects one of a plurality of gamma data sets GDS stored in the gamma data storage unit 1422, corresponding to the gamma selection signal FGS supplied from the gamma selection signal generator 190 of FIG. 1, and outputs the selected gamma data set GDS to the data driver 130 of FIG. 1. For example, the gamma selection unit 1421 selectively outputs a gamma data set GDS corresponding to the gamma selection signal FGS among the plurality of gamma data sets GDS.

For example, the gamma selection unit 1421 may selectively output gamma voltages stored in a look-up table LUT in which a gamma data set GDS corresponding to the gamma selection signal FGS is stored.

Each of the gamma data sets GDS, except gamma reference voltages VGMA_R supplied to the data driver 130 from the gamma reference voltage generator 150 of FIG. 1, may include gamma voltages. For example, each of the gamma data sets GDS may include VGMA2 to VGMA 8 and VGMA 11 to VGMA 17 except VGMA1, VGMA9, VGMA10, and VGMA 18, which are supplied to the data driver 130 from the gamma reference voltage generator 150.

A plurality of gamma data sets GDS are stored in the gamma data storage unit 1422.

The gamma data storage unit 1422 may include a plurality of look-up tables LUT in which a plurality of gamma voltages VGMA2 to VGMA8 and VGMA11 to VGMA17 included in the respective gamma data sets GDS are stored.

For example, the gamma data storage unit 1422 may include a first look-up table LUT1 in which a first gamma data set corresponding to a gamma selection signal FGS of "000" is stored, a second look-up table LUT2 in which a second gamma data set corresponding to a gamma selection signal FGS of "001" is stored, a third look-up table LUT3 in which a third gamma data set corresponding to a gamma selection signal FGS of "010" is stored, a fourth look-up table LUT4 in which a fourth gamma data set corresponding to a gamma selection signal FGS of "011" is stored, a fifth look-up table LUT5 in which a fifth gamma data set corresponding to a gamma selection signal FGS of "100" is stored, a sixth look-up table LUT6 in which a sixth gamma data set corresponding to a gamma selection signal FGS of "101" is stored, a seventh look-up table LUT7 in which a seventh gamma data set corresponding to a gamma selection signal FGS of "110" is stored, and an eighth look-up table LUT8 in which an eighth gamma data set corresponding to a gamma selection signal FGS of "111" is stored.

The gamma voltages VGMA2 to VGMA8 and VGMA11 to VGMA17, which are included in each of the first to eighth gamma data sets GDS respectively stored in the first to eighth look-up tables LUT1 to LUT8 are set to have values which may be used to compensate for variations caused by ripples of the power voltage AVDD by corresponding to the value of a gamma selection signal FGS.

Thus, although the voltage value of a power voltage AVDD is changed by the ripples of the power voltage AVDD, the gamma voltage used to generate a data signal can be adjusted according to a voltage change degree of the power voltage AVDD.

Accordingly, the difference between the power voltage AVDD and the data voltage input to the output buffer of the data driver 130 of FIG. 1 can be uniformly maintained for each grayscale value. Thus, it is possible to maintain a desired gamma value and prevent flickering. As a result, it is possible to increase the quality of images displayed in the display unit 110.

Figure 7:
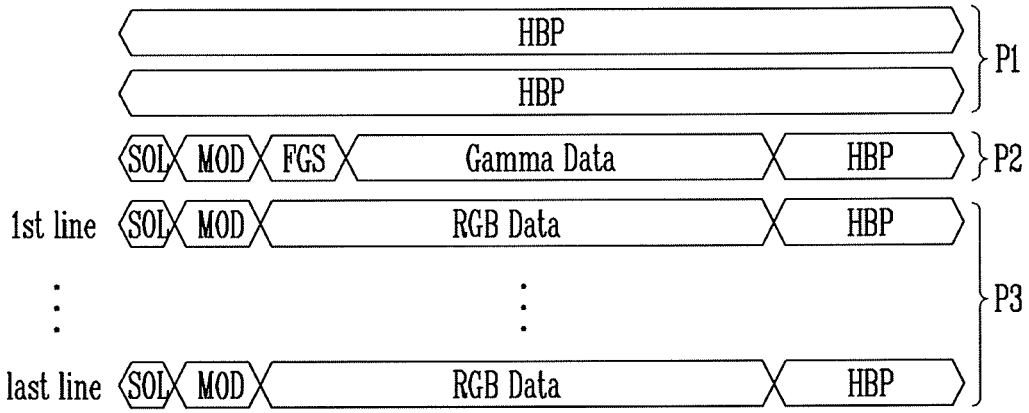
FIG. 7 is a timing diagram illustrating a method of controlling the display device according to exemplary embodiments of the present invention.

FIG. 7 is a timing diagram illustrating a method of controlling a display device according to an exemplary embodiment of the present invention.

Referring to FIG. 7, a first period P1 in which a plurality of horizontal blank periods HBP are disposed may be set as a vertical blank period. The first period P1 may include a clock training period.

After that, as a line start signal SOL is supplied, a second period P2 for supplying gamma data is started.

A mode signal MOD is supplied subsequent to the line start signal SOL and during the second period P2. The mode signal MOD may be a digital code which specifies a signal to be output. For example, a mode signal of "010 (LHL)", which notifies that gamma data are to be output, may be output during the second period P2.

According to exemplary embodiment of the present invention, the approach described with reference to FIGS. 1 to 6 may be modified such that one fixed gamma data set GDS is not output and one of a plurality of gamma data sets GDS is selected and output by a gamma selection signal FGS to which ripples of the power voltage AVDD are reflected.

Therefore, after the mode signal MOD is output, a gamma selection signal FGS is output before the transmission of gamma data, and gamma data corresponding to the gamma selection signal FGS may then be transmitted. In this case, the gamma data may be gamma voltages included in a gamma data set GDS corresponding to the gamma selection signal FGS.

According to an exemplary embodiment of the present invention, the line start signal SOL, the mode signal MOD, and/or the gamma data may be output from the timing controller 140, and the gamma selection signal FGS may be output from the gamma selection signal generator 190. After the gamma data are transmitted, a horizontal blank period HBP may be disposed.

If a line start signal SOL is again supplied after the transmission of the gamma data is completed, a third period P3 is started.

The third period P3 may be set as a period for transmitting image data RGB Data. In this case, a mode signal MOD, e.g., a mode signal of "001 (LLH)", which indicates that image data RGB Data are to be output, may be output subsequent to the line start signal SOL.

Image data RGB Data are transmitted subsequent to the mode signal MOD. In this manner, image data RGB Data of a first pixel line to image data RGB Data of the last pixel line may all be transmitted.

The image data RGB Data, as shown in FIG. 1, may be output from the timing controller 140 and input to the data driver 130.

Then, the data driver 130 generates a data signal corresponding to the image data RGB Data, using gamma reference voltages VGMA_R and a gamma data set GDS, respectively supplied from the gamma reference voltage generator 150 and the gamma data supply unit 142. The generated data signal is supplied to the pixels through the data lines DL1 to DLm.

The driving method of the display device according to an exemplary embodiment of the present invention will be briefly described in connection with FIGS. 1 to 7. The driving method of the display device according to an exemplary embodiment of the present invention includes outputting a comparison value ΔV by comparing a power voltage AVDD with at least one gamma reference voltage (e.g., a positive high gamma reference value VGMA_UH) among a plurality of gamma reference voltages VGMA_R. A gamma selection signal FGS corresponding to the comparison value ΔV is generated. A gamma data set GDS corresponding to the gamma selection signal is selected from among a plurality of previously stored gamma data sets and the selected gamma data set GDS is outputted. A data signal corresponding to input data is generated using the selected gamma data set GDS and the gamma reference voltages VGMA_R. An image corresponding to the data signal is displayed.

Here, the outputting of the comparison value ΔV may include calculating a representative value of the power voltage AVDD, e.g., an effective value AVDD_RMS in every frame period and generating the comparison value ΔV by detecting a difference between the representative value and the at least one gamma reference voltage, e.g., the positive high gamma reference voltage VGMA_UH.

The generating of the gamma selection signal FGS may include generating a digital code corresponding to a voltage range of the comparison value ΔV.

In the display device and the driving method thereof according to an exemplary embodiment of the present invention, gamma voltages used to generate a data signal can be differentially applied by reflecting an actual voltage value of the power voltage AVDD.

Accordingly, although the voltage value of the power voltage AVDD is changed by ripples of the power voltage AVDD, the gamma value of an image can be uniformly maintained. Thus, it is possible to maintain a desired gamma value and prevent flickering, thereby increasing the image quality of the display.

The present invention may be applied to large-sized display devices in which data lines are driven using a plurality of sub-data drivers.

Figure 8:
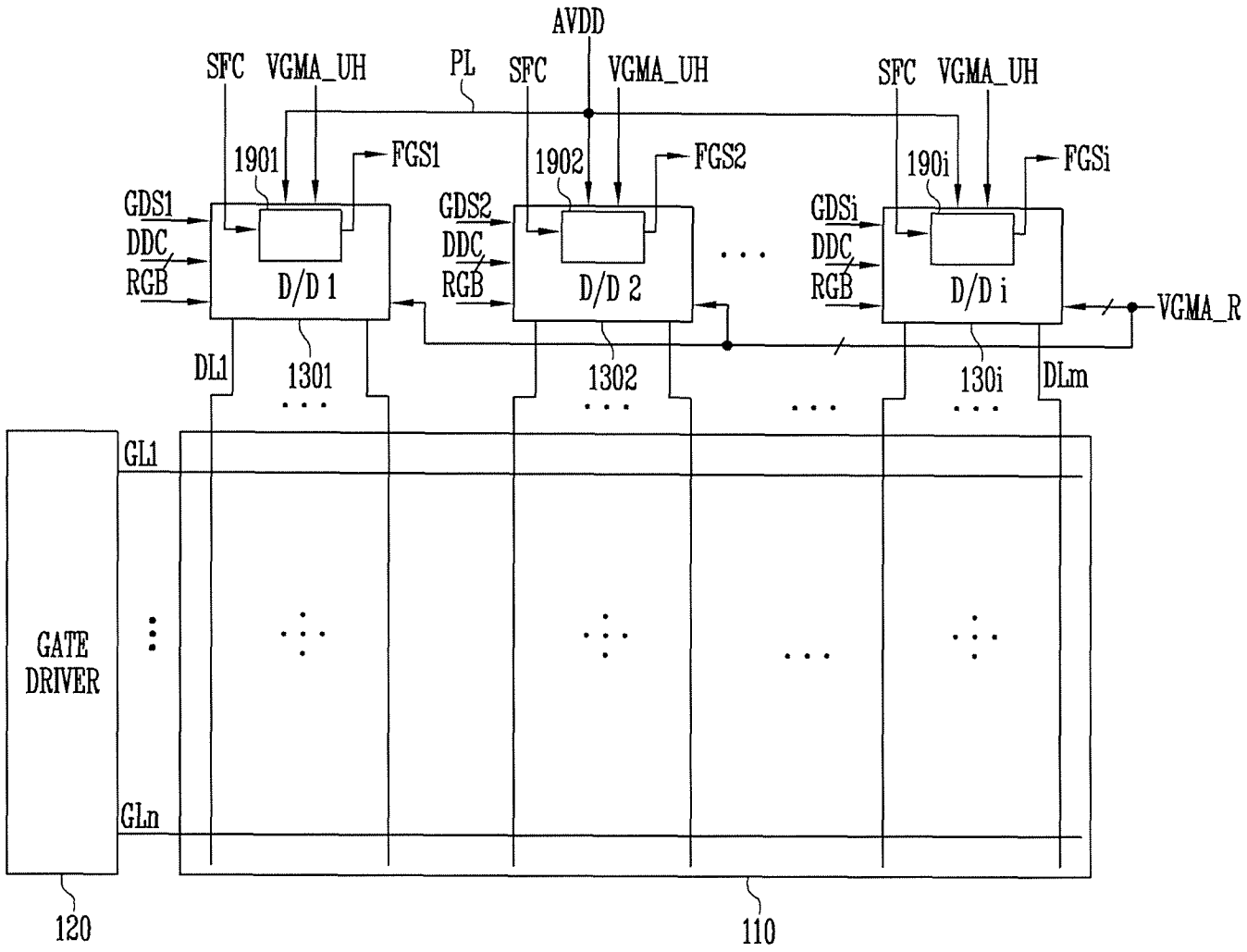
FIG. 8 is a schematic diagram illustrating a display device according to an exemplary embodiment of the present invention.

FIG. 8 is a schematic diagram illustrating a display device according to an exemplary embodiment of the present invention. For convenience, descriptions of some components overlapping with those of FIG. 1 will be omitted, and detailed descriptions of portions similar or identical to those of FIG. 1 will also be omitted.

Referring to FIG. 8, in the display device according to an exemplary embodiment of the present invention, the data lines DL1 to DLm are driven using a plurality of sub-data drivers 1301 to 130*i* (where i is a natural number of 2 or more). For example, in the case of a large-sized display device, the display device may be implemented in a structure using the plurality of sub-data drivers 1301 to 130*i* as shown in FIG. 8.

More specifically, according to the approach shown in FIG. 8, the display panel 110 is divided into a plurality of areas, and the data driver 130 of FIG. 1 is configured to be divided into the plurality of sub-data drivers 1301 to 130*i* for supplying data signals to data lines DL of the respective areas. For example, the plurality of sub-data drivers 1301 to 130*i* may constitute the data driver 130 shown in FIG. 1 while each supplies a data signal to some data lines DL among the data lines DL1 to DLm formed in the display panel 110.

The display device according to an exemplary embodiment of the present invention includes a plurality of sub-gamma selection signal generators 1901 to 190*i* respectively corresponding to the plurality of sub-data drivers 1301 to 130*i*.

The sub-gamma selection signal generators 1901 to 190*i* may be disposed adjacent to respectively power input stages in which a power voltage AVDD is input to the sub-data drivers 1301 to 130*i*. Alternatively, the sub-gamma selection signal generators 1901 to 190*i* may be provided inside the sub-data drivers 1301 to 130*i*, respectively.

In this case, gamma selection signals FGS1 to FGSi may be generated by reflecting an actual voltage value of the power voltage input to the sub-data drivers 1301 to 130*i*.

For example, the sub-gamma selection signal generators 1901 to 190*i* may receive a start frame control signal SFC, a power voltage AVDD, and at least one gamma reference voltage, e.g., a positive high gamma reference voltage VGMA_UH, respectively supplied from the timing controller 140, the DC-DC converter 180, and the gamma reference voltage generator 150 of FIG. 1, and may respectively generate gamma selection signals FGS1 to FGSi, corresponding to the start frame control signal SFC, the power voltage AVDD, and the at least one gamma reference voltage.

The gamma selection signals FGS1 to FGSi generated by the respective sub-gamma selection signal generators 1901 to 190*i* are supplied to the gamma data supply unit 142 of FIG. 1.

Then, the gamma data supply unit 142 outputs corresponding gamma data sets GDS1 to GDSi to the respective sub-data drivers 1301 to 130*i*, corresponding to the gamma selection signals FGS1 to FGSi supplied from the respective sub-gamma selection signal generators 1901 to 190*i*.

Thus, each of the sub-data drivers 1301 to 130*i* is supplied with gamma voltages capable of compensating for a variation of the power voltage according to an actual input value of the power voltage AVDD, and each of the sub-data drivers 1301 to 130*i* generates a data signal corresponding to the supplied gamma voltages.

According to an exemplary embodiment of the present invention, in the display device having the plurality of sub-data drivers 1301 to 130*i*, although actual input values of the power voltage AVDD that are input to the respective sub-data drivers 1301 to 130*i* differ depending on a length variation of a power line PL, etc., the variation of the power voltage AVDD can be compensated, thereby preventing deterioration of image quality.

As discussed above, the power voltage AVDD is input to a plurality of circuit elements, and therefore, ripples may be generated. Also, load changes corresponding to images displayed on a display panel may cause ripples of the power voltage AVDD.

According to exemplary embodiments of the present invention, gamma voltages can be selected and applied such that the gamma value of an image can be uniformly maintained by reflecting an actual voltage value of the power voltage AVDD input to the data driver, etc.

Accordingly, although ripples are generated in the power voltage AVDD, the ripples of the power voltage AVDD are compensated for using gamma voltages, so that it is possible to prevent deterioration of image quality, caused by the ripples of the power voltage.

Also, in the display device having the plurality of sub-data drivers, although there may be a variation between actual input values of the power voltage AVDD, input to the respective sub-data drivers, the variation of the power voltage AVDD can be compensated for, thereby preventing deterioration of image quality.

Example embodiments of the present invention have been disclosed herein, and although specific terms are employed, they are used and are to be interpreted in a generic and descriptive sense only and not for purpose of limitation. In some instances, as would be apparent to one of ordinary skill in the art, features, characteristics, and/or elements described in connection with a particular embodiment may be used singly or in combination with features, characteristics, and/or elements described in connection with other embodiments. Accordingly, it will be understood by those of skill in the art that various changes in form and details may be made without departing from the spirit and scope of the present invention.

What is claimed is:

1. A display device comprising:

a gamma reference voltage generator circuit generating a plurality of gamma reference voltages from a power voltage;

a gamma selection signal generator circuit generating a gamma selection signal corresponding to at least one gamma reference voltage of the plurality of gamma reference voltages and the power voltage;

a gamma data supply circuit storing a plurality of gamma data sets, and outputting a gamma data set corresponding to the gamma selection signal from among the plurality of gamma data sets;

a data driver generating a data signal, using the gamma data set output from the gamma data supply circuit and the gamma reference voltages; and a display unit which comprises a plurality of data lines carrying the data signal, wherein the gamma selection signal generator circuit includes:

a representative value calculator circuit calculating a representative value of the power voltage in each of a plurality of frame periods; and a comparator outputting a comparison value by detecting a difference between the representative value and the at least one gamma reference voltage, and wherein the comparator is synchronized with a start frame control signal supplied in each of the plurality of frame periods to output the comparison value.

2. The display device of claim 1, wherein the gamma selection signal generator circuit further includes:

an analog-to-digital converter generating the gamma selection signal corresponding to the comparison value.

3. The display device of claim 1, wherein the gamma data supply circuit includes:

a gamma data storage circuit in which the plurality of gamma data sets are stored; and a gamma selector circuit configured to selectively output a gamma data set corresponding to the gamma selection signal from among the plurality of gamma data sets.

4. The display device of claim 3, wherein the gamma data storage circuit includes a plurality of look-up tables in which a plurality of gamma voltages included in the respective gamma data sets are stored.

5. The display device of claim 1, wherein each of the plurality of gamma data sets includes a plurality of gamma voltages having values between the gamma reference voltages.

6. The display device of claim 1, further comprising a timing controller controlling the gamma selection signal generator circuit and the data driver.

7. The display device of claim 6, wherein the gamma data supply circuit is included within the timing controller.

8. A display device comprising:

a gamma reference voltage generator circuit generating a plurality of gamma reference voltages from a power voltage;

a gamma selection signal generator circuit generating a gamma selection signal corresponding to at least one gamma reference voltage of the plurality of gamma reference voltages and the power voltage;

a gamma data supply circuit storing a plurality of gamma data sets, and outputting a gamma data set corresponding to the gamma selection signal from among the plurality of gamma data sets;

a data driver generating a data signal, using the gamma data set output from the gamma data supply circuit and the gamma reference voltages; and a display unit which comprises a plurality of data lines carrying the data signal, wherein the data driver includes a plurality of sub-data drivers, each of which supplies a data signal to some data lines from among the plurality of data lines, wherein the gamma selection signal generator circuit includes a plurality of sub-gamma selection signal generators provided in respective sub-data drivers of the plurality of sub-data drivers, and wherein the gamma data supply circuit outputs the gamma data set to each of the plurality of sub-data drivers, the gamma data set corresponding to the gamma selection signal input from each of the plurality of sub-gamma selection signal generators.

9. A method of driving a display device, the method comprising:

comparing a power voltage with at least one gamma reference voltage from among a plurality of gamma reference voltages and outputting a resulting comparison value;

generating a gamma selection signal corresponding to the comparison value;

selecting a gamma data set corresponding to the gamma selection signal from among a plurality of previously stored gamma data sets, and outputting the selected gamma data set;

generating a data signal corresponding to input data, using the selected gamma data set and the plurality of gamma reference values; and displaying an image corresponding to the generated data signal, wherein the outputting of the comparison value includes:

calculating a representative value of the power voltage synchronized with a start frame control signal supplied in each of a plurality of frame periods; and generating the comparison value by detecting a difference between the representative value and the at least one gamma reference voltage.

10. The method of claim 9, wherein the generating of the gamma selection signal includes generating a digital code corresponding to a voltage range of the comparison value.

* * * * *